US010859948B2

(12) United States Patent
Imagawa et al.

(10) Patent No.: US 10,859,948 B2
(45) Date of Patent: Dec. 8, 2020

(54) DEVELOPING DEVICE AND IMAGE FORMING APPARATUS

(71) Applicant: SHARP KABUSHIKI KAISHA, Sakai (JP)

(72) Inventors: Shinji Imagawa, Sakai (JP); Hideaki Kurimoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/660,039

(22) Filed: Oct. 22, 2019

(65) Prior Publication Data

US 2020/0133166 A1 Apr. 30, 2020

(30) Foreign Application Priority Data

Oct. 25, 2018 (JP) ..... 2018-201137

(51) Int. Cl.
*G03G 15/08* (2006.01)
*G03G 21/16* (2006.01)

(52) U.S. Cl.
CPC ..... *G03G 15/0891* (2013.01); *G03G 15/0877* (2013.01); *G03G 15/0889* (2013.01); *G03G 21/1647* (2013.01); *G03G 2215/0827* (2013.01)

(58) Field of Classification Search
CPC ..... G03G 15/104; G03G 15/0887; G03G 15/0889; G03G 15/0891; G03G 15/0893; G03G 15/0896; G03G 2215/08; G03G 2215/0802; G03G 2215/0819; G03G 2215/0822; G03G 2215/0836; G03G 2215/0838
See application file for complete search history.

(56) References Cited

U.S. PATENT DOCUMENTS

2017/0219955 A1 8/2017 Uchida et al.

FOREIGN PATENT DOCUMENTS

JP 2017058440 A * 3/2017
JP 2017-134234 A 8/2017

* cited by examiner

*Primary Examiner* — Thomas S Giampaolo, II
(74) *Attorney, Agent, or Firm* — ScienBiziP, P.C.

(57) ABSTRACT

A developing device includes a developer tank holding a developer, and a transporting member stirring and transporting the developer. The transporting member includes first and second screws each provided with a rotary shaft having a spiral blade disposed on an outer circumferential face of the rotary shaft. The first and second screws are disposed such that the rotary shafts are parallel to each other. The developer tank includes a first compartment accommodating the first screw, a second compartment accommodating the second screw, a partition separating the first compartment and the second compartment, and a circulation zone. The circulation zone includes an opening in the partition that allows the developer to flow through. The first and second compartments have bottom faces at different heights. A protrusion is formed on a bottom face in the circulation zone.

13 Claims, 11 Drawing Sheets

DEVELOPING DEVICE AND IMAGE FORMING APPARATUS

BACKGROUND OF THE INVENTION

Field of the Invention

The present invention relates to a developing device including a developer tank, and an image forming apparatus.

Description of the Background Art

Electrophotographic image forming apparatus have been known. Such image forming apparatuses include developing devices including developing units containing developers. Such a developing device supplies a developer used for image formation. The volume of developer supplied fluctuates due to tilt of the developing or other factors. Thus, a technique to suppress the fluctuation has been proposed (for example, refer to Japanese Unexamined Patent Application Publication No. 2017-134234).

The image forming apparatus described in Japanese Unexamined Patent Publication No. 2017-134234 includes a storage tank that stores powder, a transport member that transports the powder in the storage tank, a powder outlet provided in the wall of the storage tank, and a closing member that closes the lower portion of the outlet and shifts vertically. In the above-described image forming apparatus, the closing member is shifts vertically to adjust the area of the outlet and suppress a fluctuation in the amount of powder going out.

The above-described image forming apparatus includes two transport members each consisting of a rotary shaft and a spiral blade disposed on an outer circumferential face of the rotary shaft. The transport members rotate to stir the developer while transporting the developer in a direction along the rotary shaft. The storage tank is divided into two rooms, each of which is provided with one of the transport members. The developer transported to the end of one of the rooms by one of the transport members moves into another room through an opening, is transported to an opposite end, and circulates the storage tank.

Japanese Unexamined Patent Publication No. 2017-134234 considers the possibility of installing the storage tank at an angle inside the image forming apparatus. However, the influence of the tilt of the storage tank on the transportability of the developer in a turn-back zone where the developer moves to the other room is not considered. Thus, tilting the storage tank may impair smooth transportation of the developer.

An object of at least an embodiment of the present invention, which has been conceived to solve the above-described issue, is to provide a developing device and an image forming apparatus that can smoothly circulate the developer even when the bottom face of the developer tank has a height difference.

SUMMARY OF THE INVENTION

A developing device according to at least an embodiment of the present invention includes a developer tank that holds a two-component developer comprising a toner and a magnetic carrier, and a transporting member that stirs and transports the two-component developer in the developer tank, the transporting member including a first screw comprising a first rotary shaft having a first spiral blade disposed on an outer circumferential face of the first rotary shaft, and a second screw comprising a second rotary shaft having a second spiral blade disposed on an outer circumferential face of the second rotary shaft, the first screw and the second screw being disposed such that the first rotary shaft and the second rotary shaft are parallel to each other, and rotating to circulate the two-component developer in the developer tank, the developer tank including a first compartment accommodating the first screw, a second compartment accommodating the second screw, a partition that separates the first compartment and the second compartment, and a circulation zone disposed at an end in an axial direction along the first and second rotary shafts, the circulation zone including an opening in the partition, that allows the two-component developer to flow through between the first compartment and the second compartment, the first compartment and the second compartment having bottom faces at different heights, and a protrusion being formed on a bottom face in the circulation zone.

In the developing device according to at least an embodiment of the present invention, the circulation zone may include a first circulation zone that is disposed at one end in the axial direction and allows the two component developer to flow from the second compartment to the first compartment, and a second circulation zone that is disposed at another end in the axial direction and allows the two-component developer to flow from the first compartment to the second compartment, and the protrusion may be provided in the first circulation zone and the second circulation zone.

In the developing device according to at least an embodiment of the present invention, the protrusion may include a slope that varies the height of the protrusion along a direction in which the two-component developer flows.

In the developing device according to at least an embodiment of the present invention, one of the first screw and the second screw may be disposed upstream in a flow direction and rotates to move the two-component developer from above downward on a side facing the partition, and another one of the first screw and the second screw may be disposed downstream in the flow direction and rotates to move the two-component developer from above downward on a side facing the partition, the flow direction being a direction in which the two-component developer flows in the circulation zone.

In the developing device according to at least an embodiment of the present invention, at least one of the first screw and the second screw may have a rib in an area facing the circulation zone, the rib extending and being erected on the outer circumferential face of the first or second rotary shaft.

In the developing device according to at least an embodiment of the present invention, a bottom face of the developer tank is so tilted as to vary in height between the first compartment and the second compartment.

In the developing device according to at least an embodiment of the present invention, a bottom face of the developer tank may have a step defined by the first compartment and the second compartment.

In the developing device according to at least an embodiment of the present invention, at least one of the first screw and the second screw may have a varied-diameter section in an area facing the circulation zone, the varied-diameter section being different from other sections in diameter of the first or second rotary shaft.

An image forming apparatus according to at least an embodiment of the present invention includes the developing device according to at least and embodiment of the present invention.

According to at least an embodiment of the present invention, a protrusion is disposed in the circulation zone, to prevent backflow of the developer passing over the protrusion, and can smoothly circulate the developer even when the bottom face of the developer tank has a height difference.

DESCRIPTION OF THE PREFERRED EMBODIMENTS

First Embodiment

An image forming apparatus according to a first embodiment of the present invention will now be described with reference to the accompanying drawings.

Figure 1:
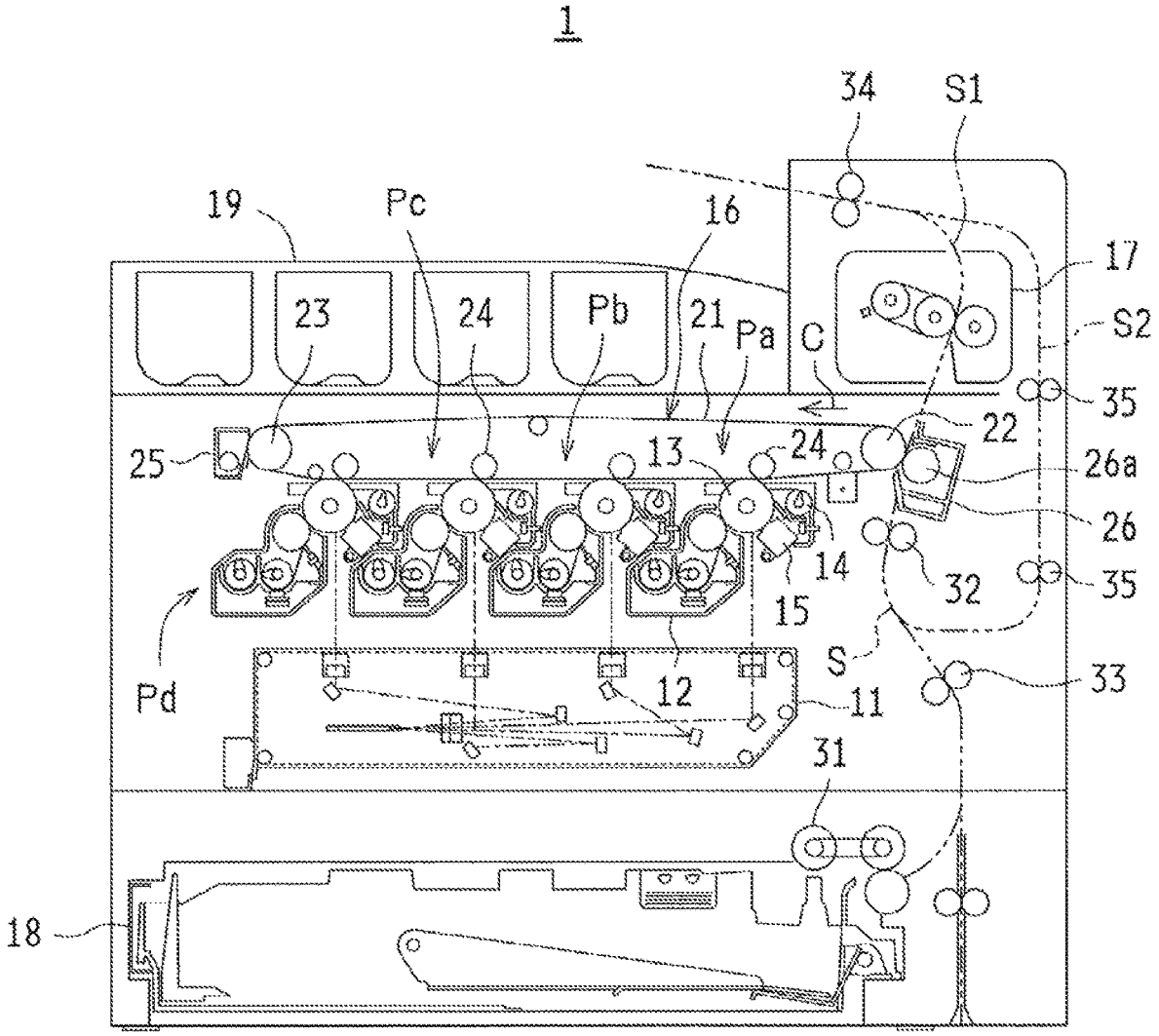
FIG. 1 is a schematic side view f an image forming apparatus according to a first embodiment of the present invention.

FIG. 1 is a schematic side view of a image forming apparatus 1 according to the first embodiment of the present invention.

The image forming apparatus 1 according to the first embodiment of the present invention includes an exposure device 11, developing devices 12, photosensitive drums 13, cleaners 14, chargers 15, an intermediate-transfer-belt unit 16 a fixing device 17, a sheet feeder tray 18, an output tray 19, and a sheet path S. The image forming apparatus 1 forms a multicolor or monochrome image on a predetermined sheet in accordance with image data from an external device.

The image data processed by the image forming apparatus 1 corresponds to a color image in the colors of black (K), cyan (C), magenta (M), and yellow (Y). Hence, four image stations Pa, Pb, Pc, and Pd are provided to form four latent images in black, cyan, magenta, and yellow. The image stations Pa, Pb, Pc, and Pd for the respective colors each dudes a developing device 12, a photosensitive drum 13, a charger 15, and a cleaner 14.

The photosensitive drums 13 are disposed at the substantial center of the image forming apparatus 1. The chargers 15 uniformly charge the surfaces of the corresponding photosensitive drums 13 to a predetermined potential. The exposure device 11 exposes the surfaces of the photosensitive drums 13 to form electrostatic latent images. The developing devices 12 develop the corresponding electrostatic latent images on the surfaces of the corresponding photosensitive drums 13, and form toner images on the surfaces of photosensitive drums 13. Through the series of operations described above, toner images of the respective colors are formed on the surfaces of the photosensitive drums 13. The cleaners 14 remove and collect the toners remaining on the surfaces of the photosensitive drums 13 after development and image transfer. Note that the detailed structure of the developing devices 12 will be described in detail below with reference to FIGS. 2 to 3B.

An intermediate-transfer-belt unit 16 is disposed above the photosensitive drums 13, and includes an intermediate transfer belt 21, an intermediate-transfer-belt driving roller 22, an intermediate-transfer-belt driven roller 23, intermediate rollers 24, and an intermediate-transfer-belt cleaner 25. Four intermediate transfer rollers 24 are provided for the image stations of the respective YMCK colors.

The intermediate transfer belt 21 is extended across the intermediate-transfer-belt driving roller 22, the intermediate-transfer-belt driven roller 23, and the intermediate transfer rollers 24, such that the surface of intermediate transfer belt 21 is moved in a predetermined direction (direction of arrow C in the drawing) by the rollers.

While the intermediate transfer belt 21 moves in the direction of arrow C, the intermediate-transfer-belt cleaner 25 removes and collects the residual toners, and the toner images of the respective colors on the surfaces of the photosensitive drums 13 are sequentially transferred and overlaid with each other onto the surface of the intermediate transfer belt 21 so as to form a color toner image on the surface of the intermediate transfer belt 21.

The image forming apparatus 1 further includes a secondary transfer device 26 including a transfer roller 26*a*. A nip is defined between the transfer roller 26*a* and the intermediate transfer belt 21. A sheet transported through the sheet path S is fed through the nip. When the sheet passes through the nip, the color toner image on the surface of the intermediate transfer belt 21 is transferred onto the sheet.

The sheet feeder tray 18 stores sheets to be used for image formation, and is disposed below the exposure device 11. The output tray 19 is disposed in the upper portion of the image forming apparatus 1, and receives the sheets on which images have been formed.

The sheet path S includes an S-shaped main path S1, and a reverse path S2 that branches from the main path S1 and rejoins the main path S1. A pickup roller 31, pre-registration rollers 33, registration rollers 32, the secondary transfer device 26, the fixing device 17, and output rollers 34 are disposed along the main path S1. The reverse path S2 branches from the main path S1 between the fixing device 17 and the output rollers 34, passes through multiple transport rollers 35, and rejoins the main path S1 between the pre-registration roller 33 and the registration rollers 32.

The pickup roller 31 is a lead-in roller that is disposed near the end of the sheet feeder tray 18, and feeds each sheet in the sheet feeder tray 18 to the sheet path S. The registration rollers 32 temporarily hold the sheet transported from the sheet feeder tray 18, and feed the sheet to the transfer roller 26*a* at a timing that aligns the front edge of the sheet and the front edge of the toner image on the intermediate transfer belt 21. The pre-registration rollers 33 are small auxiliary rollers that support, the transportation of the sheet.

The fixing device 17 is of a belt fixing type, and includes a fixing roller 41, a heating roller 43, and a fixing belt 44 is round around the rollers. In the fixing device 17, a pressing roller 42 presses the fixing roller 41 across the fixing belt 44. The fixing device 17 receives the sheet having the unfixed toner image. The sheet is transported between the fixing belt 44 and the pressing roller 42 for fixing. The sheet having the fixed toner image is outputted by the output rollers 34 on the output tray 19.

When an image is also to be formed on a back face of the sheet, the output rollers 34 send the sheet in an opposite direction into the reverse path S2, and the sheet is flipped over. The flipped sheet is resent to the registration rollers 32. An image is formed on the back face of the sheet in the same manner as that formed on the front face. The sheet is then output on the output tray 19.

A structure of the developing devices 12 will be described below with reference to FIGS. 2 to 3B.

Figure 2:
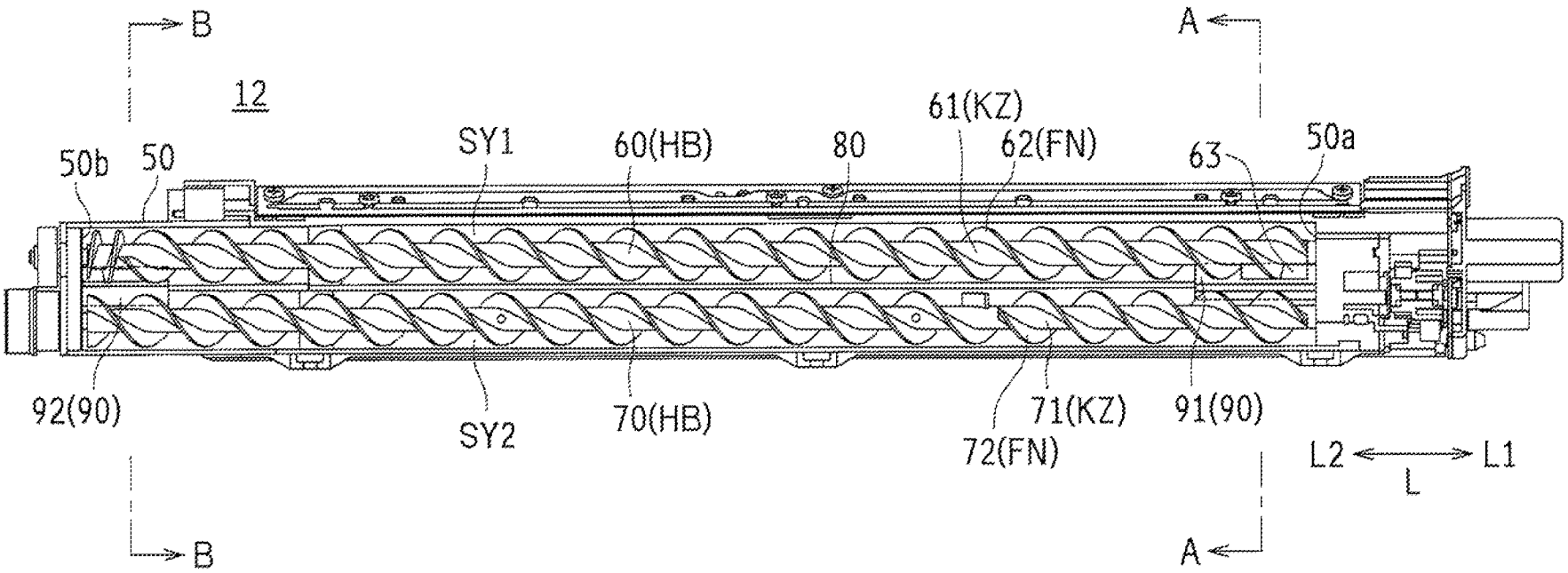
FIG. 2 is a cross-sectional top view of a developing device.
Figure 3A:
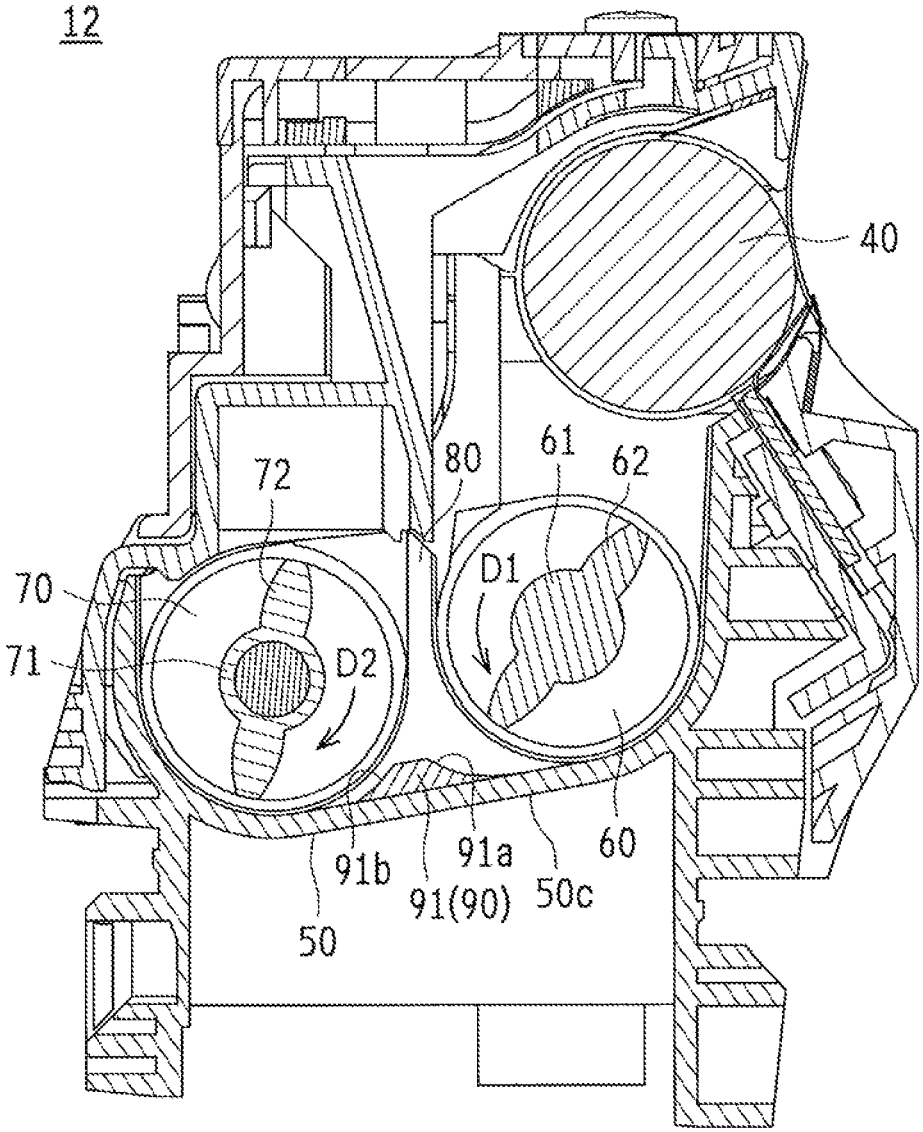
FIG. 3A is a cross-sectional side view taken along line A-A in FIG. 2.

FIG. 2 is a cross-sectional top view of a developing device 12. FIG. 3A is a cross-sectional side view taken along line A-A in FIG. 2. FIG. 3B is a cross-sectional side view taken along line B-B in FIG. 2. Note that, in FIG. 2, a developing roller 40 is omitted from the developing device 12, and hatching is omitted to facilitate viewing.

The developing device 12 mainly includes a developing roller 40, a developer tank 50, and transport members HB. Note that, in addition to the above, the developing device 12 may include members that reinforce the components and a member that support the developing device 12 so as to be detachable from the image forming apparatus 1.

The developing roller 40 abuts the corresponding photosensitive drum 13, and supplies toner to the photosensitive drum 13. In this embodiment, the developing roller 40 is disposed above the developer tank 50. Alternatively, the developing roller 40 may be disposed anywhere facing the portion of the developer tank 50 through which toner is supplied to the outside.

The developer tank 50 is a container having a hollow inside, and contains a two-component developer consisting of a toner and a magnetic carrier. Note that, hereinafter, the two-component developer may be also be referred to as "developer." The transport members FIB are disposed inside the developer tank 50, and are a first screw 60 and a second screw 70 each having a spiral blade FN disposed on an outer circumferential face of a rotary shaft KZ. The first screw 60 and the second screw 70 are disposed such that their rotary shafts KZ face each other in parallel, and rotate to circulate the developer in the developer tank 50.

The developer tank 50 has a first compartment SY1 accommodating the first screw 60 and a second compartment SY2 accommodating the second screw 70. The first compartment SY1 and the second compartment SY2 are separated by a partition 80. No that, hereinafter, the rotary shaft KZ and the spiral blade FN of the first screw 60 may also be referred to as "first shaft 61" and "first blade 62," respectively, and the rotary shaft KZ and the spiral blade FN of the second screw 70 may also be referred to as "second shaft 71" and "second blade 72" respectively, to distinguish each components of the first screw 60 and the second screw 70. Along an axis L parallel to the rotary shafts KZ, a direction toward one end (first end 50*a*) of the developer tank 50 is defined as a first axial direction L1 (toward the right in FIG. 2), and a direction toward another end (second end 50*b*) of the developer tank 50 is defined as a second axial direction L2 (toward the left in FIG. 2).

The partition 80 has openings at positions corresponding to end portions of the first compartment SY1 and the second compartment SY2 along the axis L. This provides circulation zones through which the developer circulates through the first compartment SY1 and the second compartment SY2 (first circulation zone R1 and second circulation zone R2, described below). Note that, the rotating directions of the transport members HB and the flow of the developer in the developer tank 50 will be described in detail below with reference to FIG. 5.

A bottom face of the developer tank 50 (tank bottom face 50*c*) is disposed at an angle such that the height gradually varies from the first compartment SY1 to the second compartment SY2. That is, there is a height difference between a bottom face of the first compartment SY1 and a bottom face of the second compartment SY2. In this embodiment, the first compartment SY1 is disposed higher than the second compartment SY2, as illustrated in FIGS. 3A and 3B.

The tank bottom face 50*c* has protrusions 90 protruding upward in the area corresponding to the circulation zones. In this embodiment, two protrusions 90 are provided: a first protrusion 91 disposed adjacent to the first end 50*a*, and a second protrusion 92 disposed adjacent to the second end 50*b*.

The protrusions 90 have slopes where the height gradually varies along circulating directions of the developer in the circulation zones. Specifically, the first protrusion 91 has an upper first slope 91*a* facing the first screw 60 and a lower first slope 91*b* facing the second screw 70. The second protrusion 92 has an upper second slope 92*a* facing the first screw 60 and a lower second slope 92*b* facing the second screw 70. The slopes ease the sudden height difference in the flowing direction such that the developer moves along the slopes without stagnation.

Figure 3B:
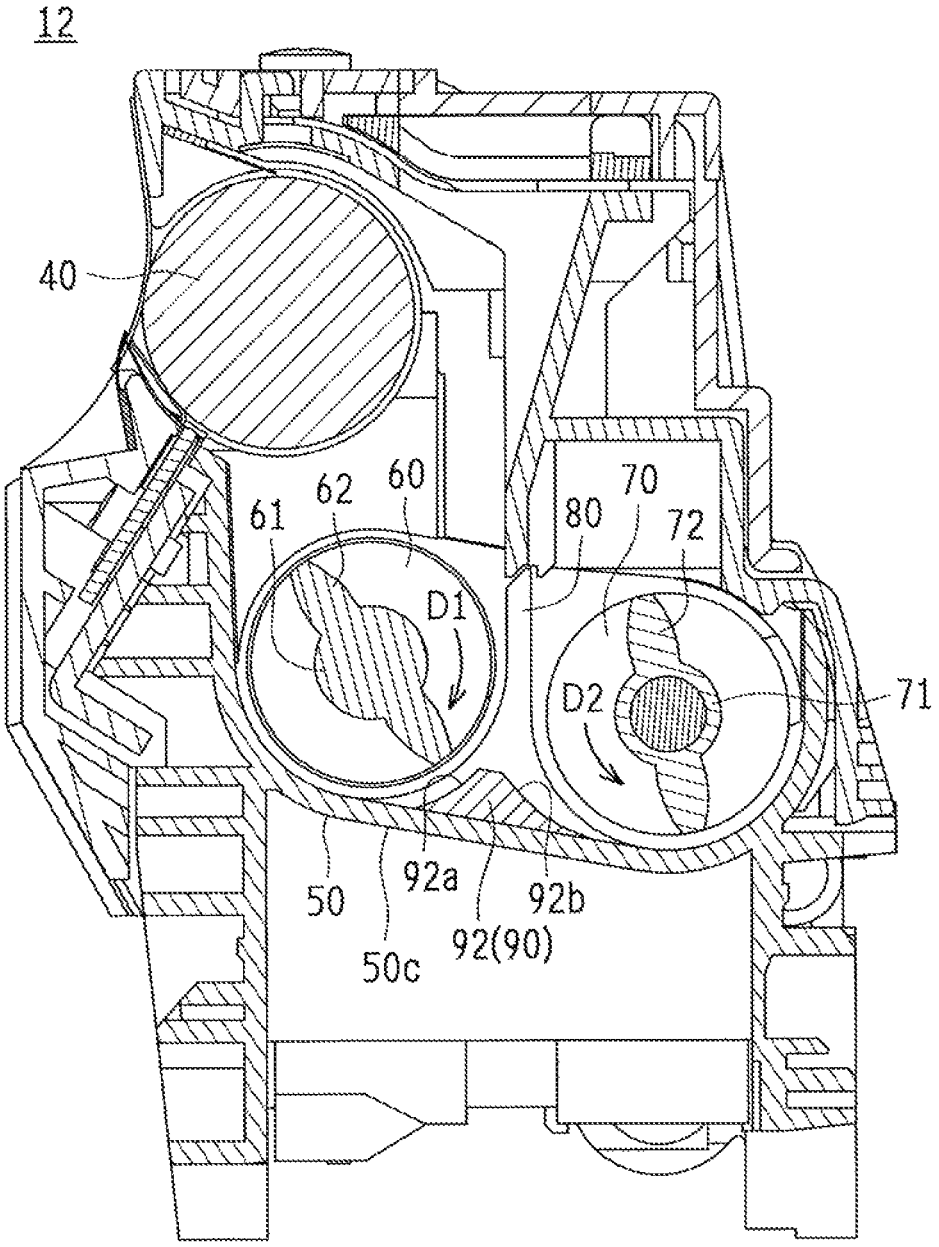
FIG. 3B is a cross-sectional side view taken along line B-B in FIG. 2.

In the structures illustrated in FIGS. 3A and 3B, tilt angles of the slopes are similar. Alternatively, the tilt angles may differ depending on the positions of the slopes relative to a flow direction. Specifically, a portion that guides the developer upward (for example, the lower first slope 91*b*) has a steep angle so as to prevent the developer from abruptly flowing in the flow direction. Furthermore, a gap between the spiral blade FN and the protrusion 90 may be narrowed along this portion to narrow a flow channel of the developer.

A portion that guides the developer downward (for example, the upper second slope 92*a*) has a gradual angle so as to prevent the developer from abruptly flowing in the flow direction. Furthermore, a gap between the spiral blade FN and the protrusion 90 may be widened along this portion to reduce a volume of the developer flowing in the flow direction.

Figure 4:
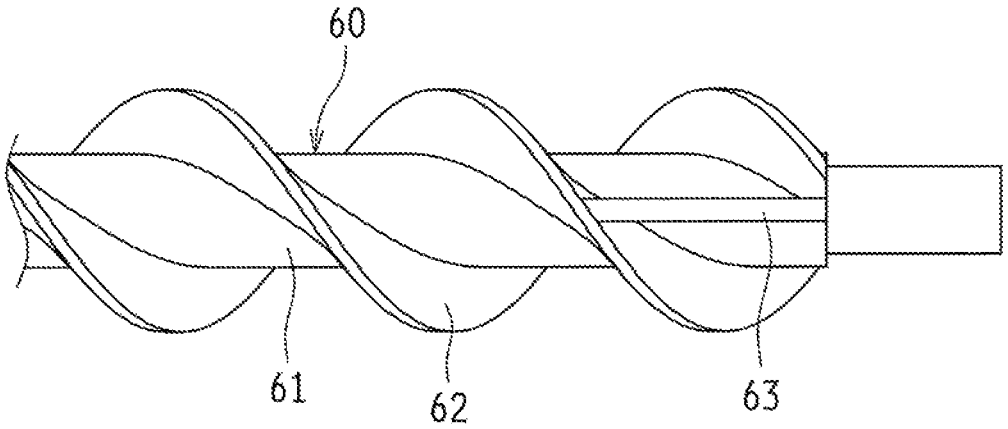
FIG. 4 is a enlarged view of a portion of a first screw.

FIG. 4 is a enlarged view of a portion of the first screw 60.

FIG. 4 is an enlarged view of a portion of the first screw 60 at the first end 50*a* of the developer tank 50. The first screw 60 has a rib 63 on the portion facing the circulation zone. The rib 63 extends along the first screw 60 in an axial direction L and erects on the outer circumferential face of the rotary shaft KZ. The rib 63 disposed on the outer circumferential face of the rotary shaft KZ scrapes up the developer, thereby smoothly moving the developer through the circulation zone. FIGS. 2 and 4 illustrate a configuration of the first screw 60 having the rib 63 on the first end 50*a*. Alternatively, the rib 63 may be disposed on the second screw 70, or on the second end 50*b* of the developer tank 50.

Figure 5:
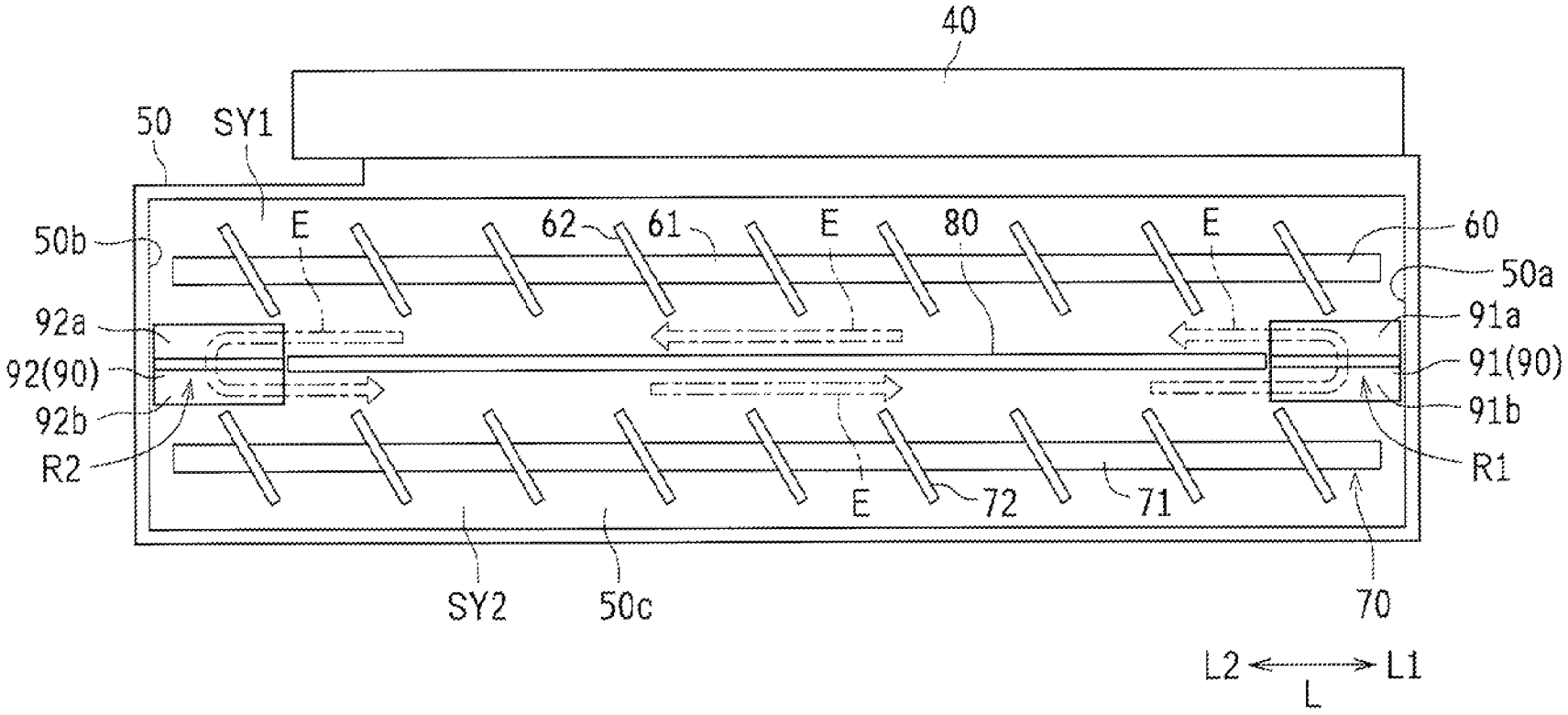
FIG. 5 is a schematic top view of a configuration of the developing device.

FIG. 5 is a schematic top view of the configuration of the developing device.

FIG. 5 is a perspective view of the structure inside the developer tank 50. In FIG. 5, to facilitate visibility, the developing roller 40 is illustrated so as not to overlap with the first screw 60 and so on.

As described above, the developer is circulated through the developer tank 50. A direction in which the developer circulates (circulation direction E) changes appropriately depending on the location in the developer tank 50.

Specifically, the circulation direction E is the second axial direction L2 from the first end 50*a* (the right end in FIG. 5) to the second end 50*b* (the left end in FIG. 5) of the first compartment SY1. The developer transported to the second end 50*b* moves to the second compartment SY2 through the second circulation zone R2. That is, the circulation direction E in the vicinity of the second end 50*b* of the developer tank is the direction from the first compartment SY1 to the second compartment SY2 (downward in FIG. 5).

The circulation direction E in the second compartment SY2 is the first axial direction L1 from the second end 50*b* toward the first end 50*a*. The developer transported to the first end 50*a* moves to the first compartment SY1 through the first circulation zone R1. That is, the circulation direction E in the vicinity of the first end 50*a* of the developer tank is the direction from the second compartment SY2 to the first compartment SY1 (upward in FIG. 5).

A movement of the developer near the first end 50*a* of the developer tank will now be described with reference to FIGS. 3A and 5.

As described above, the developer moves from the second compartment SY2 to the first compartment SY1 near the first end 50*a*. At this time, the developer accumulated on the tank bottom face 50*c* moves over the first protrusion 91 toward the first compartment SY1. The tank bottom face 50*c* is tilted such that the second compartment SY2 is lower than the first compartment SY1. This causes the developer to flow back to the second compartment SY2. However, the developer flowing back is blocked by the first protrusion 91.

The movement of the developer near the second end 50*b* of the developing tank will now be described with reference to FIGS. 3B and 5.

The developer moves over the second protrusion 92 from the first compartment SY1 to the second compartment SY2 near the second end 50*b* of the developer tank. At this time, the tilt of the tank bottom face 50*c* causes the developer to slide down to the second compartment SY2. However, a portion of the developer is blocked by the second protrusion 92.

As described above, the protrusions 90 are disposed in the circulation zone, to prevent backflow of the developer passing over the projections 90, and can smoothly circulate the developer even when the bottom face of the developer tank 50 has a height difference.

By disposing the protrusions 90 disposed on the portion (in first circulation zone R1) of the tank bottom face 50*c* where the developer flows upward and the portion (in the second circulation zone R2) of the tank bottom face 50*c* where the developer flows downward, the developer circulates even more stably. In other words, the developer is prevented from flowing back in the first circulation zone R1. In the second circulation zone R2, the protrusion 90 blocks a portion of the developer so as to prevent the developer from flowing down at once and causing a reduction in the developer.

In this embodiment, the first screw 60 rotates to move the developer from above downward on a side facing the partition 80 (in a direction D1 indicated by an arrow), and the second screw 70 rotates to move the developer from above downward on the side face of the partition 80 (in a direction D2 indicated by an arrow).

Second Embodiment

An image forming apparatus (developing device) according to a second embodiment of the present invention will now be described with reference to the accompanying drawings. Note that the structure of the image forming apparatus according to the second embodiment is substantially the same as that of the first embodiment. Thus, the same reference numerals are used, and redundant descriptions and drawings are omitted.

Figure 6:
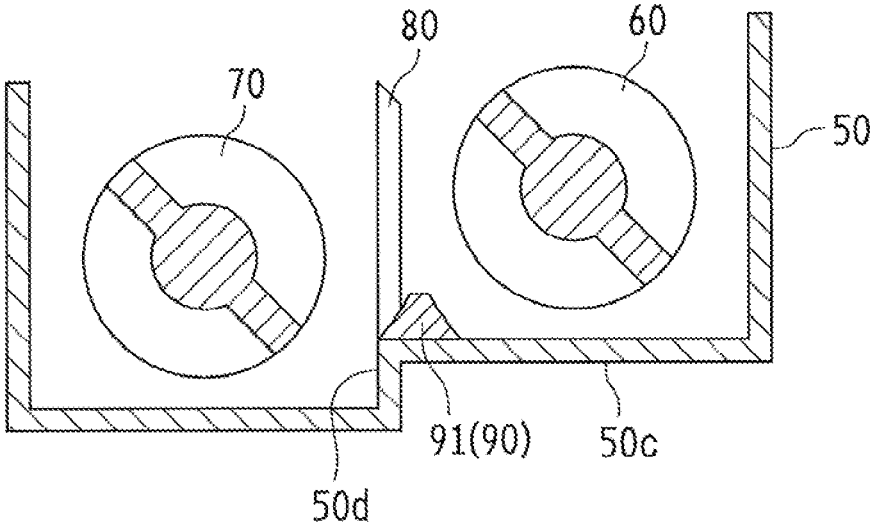
FIG. 6 is a cross-sectional schematic view of a developing device according to a second embodiment of the present invention.

FIG. 6 is a cross-sectional schematic view of a developing device according to a second embodiment of the present invention.

The developing device according to the second embodiment differs from that according to the first embodiment in that a shape of the tank bottom face 50*c* is different. Other components according to the second embodiment are substantially the same as those according to the first embodiment. FIG. 6 illustrates a cross section of the portion corresponding to the first circulation zone R1, and omits the development roller 40, etc.

In the second embodiment, the tank bottom face 50*c* has a step 50*d* that causes the height of the first compartment SY1 to differ from that of the second compartment SY2. The step 50*d* can readily connect the first compartment SY1 and the second compartment SY2, and enhance the flexibility of the design. Even when the tank bottom face 50*c* has the step 50*d*, the protrusion 90 restricts the developer from moving from a high position to a low position, thereby smoothly circulating the developer.

Third Embodiment

An image forming apparatus (developing device) according to a third embodiment of the present invention will now be described with reference to the accompanying drawings. Note that the structure of the image forming apparatus according to the third embodiment is substantially the same as those of the first and second embodiments. Thus, the same reference numerals are used, and redundant descriptions and drawings are omitted.

Figure 7A:
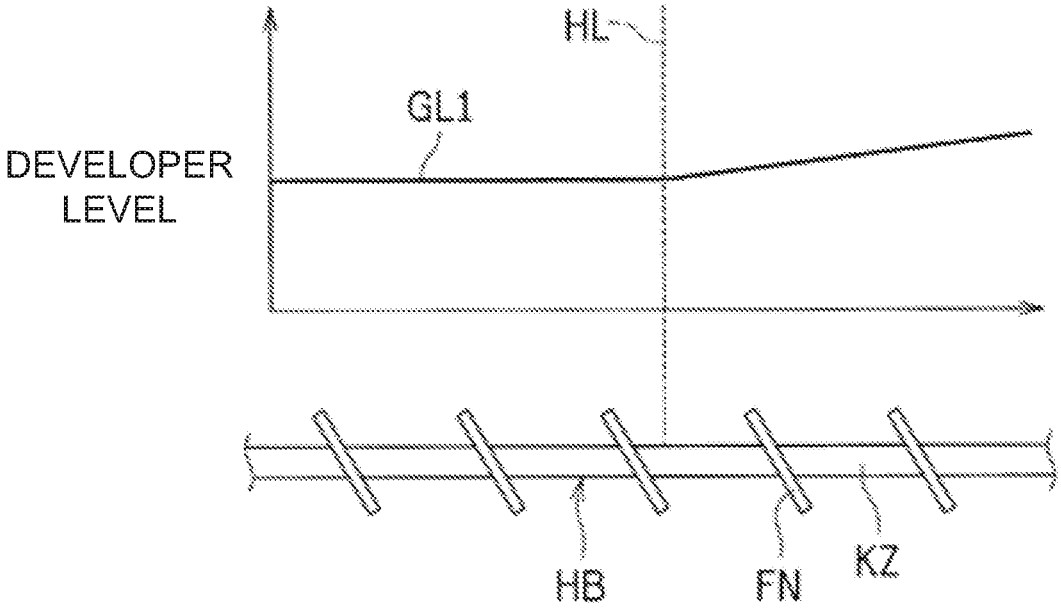
FIG. 7A illustrates a first explanatory example of the distribution of the developer level when each rotary shaft has a uniform diameter.
Figure 7B:
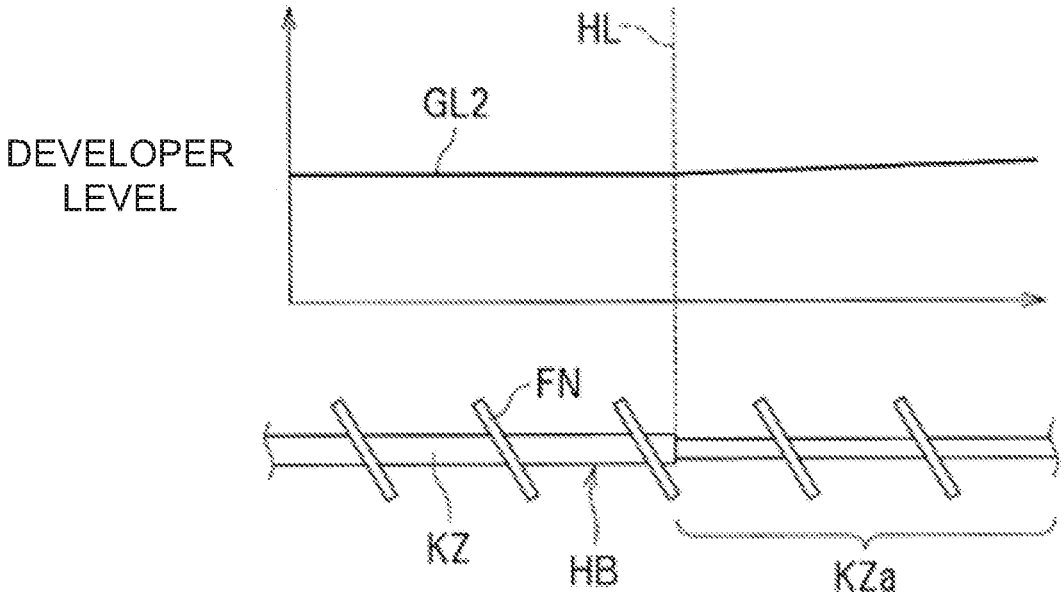
FIG. 7B illustrates an example of the distribution of the developer level when the diameter of the rotary shaft is smaller than that in the first explanation example.

FIG. 7A illustrates a first explanatory example of the distribution of the developer level when each rotary shaft has a uniform diameter. FIG. 7B illustrates an example of the distribution of the developer level when the diameter of a rotary shaft is smaller than that in the first explanation example.

The developing device according to the third embodiment differs from that according to the first embodiment in that a transport member HB has a varied-diameter section having a diameter different from that of the rotary shaft KZ. FIGS. 7A and 7B illustrate the distribution of the developer level relative to the position on the rotary shaft KZ in the axial direction L. In FIGS. 7A and 7B, the developer level or the height of accumulated developer is represented by the vertical axes in the graphs, where the largest value is at the top.

Typically, the levels of developer accumulated in different components vary depending on the structure of the developer tank 50. For example, in turn-back zones, such as the first end 50*a* and the second end 50*b* of the developer tank, the flow of the developer changes direction and slows down, thereby causing a part of the developer to stagnate.

FIG. 7A illustrates the developer level indicated by the first level line GL1 corresponding to an area where a larger volume of developer is accumulated than in other areas. The first level line GL1 is constant until it reaches a predetermined position, but gradually increases from the auxiliary line HL (to the right of the auxiliary line HL in FIG. 7A).

FIG. 7B illustrates the developer level indicated by the second level line GL2 corresponding to the same area as that illustrated in FIG. 7A. The rotary shaft KZ illustrated in FIG. 7B has a thin shaft portion KZa (varied-diameter section), unlike that illustrated in FIG. 7A. The thin shaft portion KZa has a diameter smaller than that of the other sections of the rotary shaft KZ. Note that, the outer diameter of the spiral blade FN is uniform, and the outer diameter of the transport member HB is unchanged. The small diameter of the thin shaft portion KZa of the rotary shaft KZ enhances the transportability of the developer, and thereby reduces the volume of stagnated developer. As a result, the developer level, which is indicated by the second level line GL2, decreases in the area corresponding to the thin shaft portion KZa. Thus, the developer level in the area corresponding to the thin shaft portion KZa becomes substantially the same as that in other areas.

The varied-diameter section may have any structure, besides having a diameter smaller than that of the rotary shaft KZ. For example, the diameter of the rotary shaft KZ may be increased. The case in which the diameter of the rotary shaft KZ is increased will now be described with reference to FIGS. 8A and 8B.

Figure 8A:
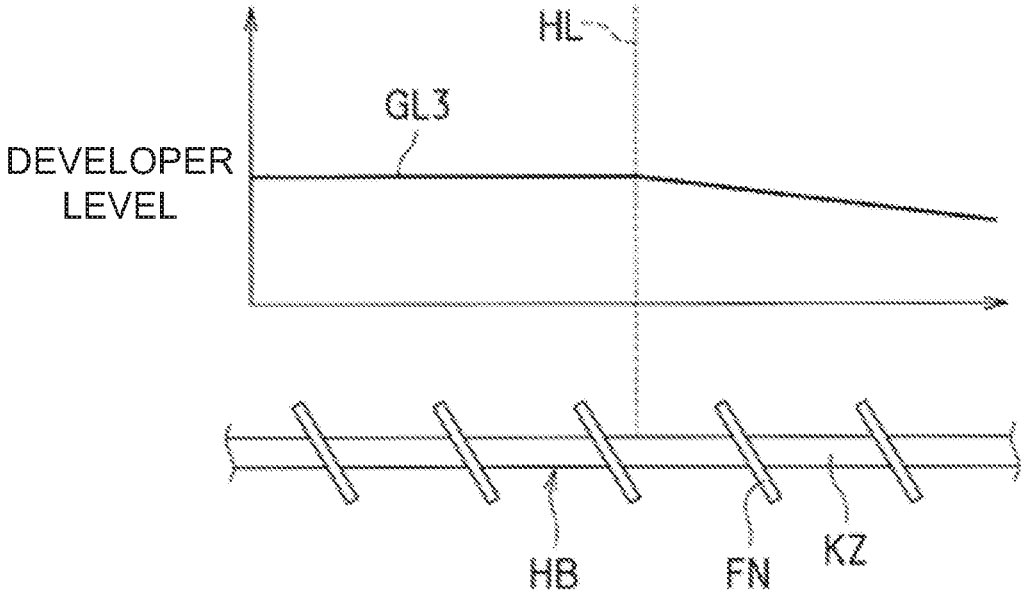
FIG. 8A illustrates a second explanatory example of the distribution of the developer level when each rotary shaft has a uniform diameter.
Figure 8B:
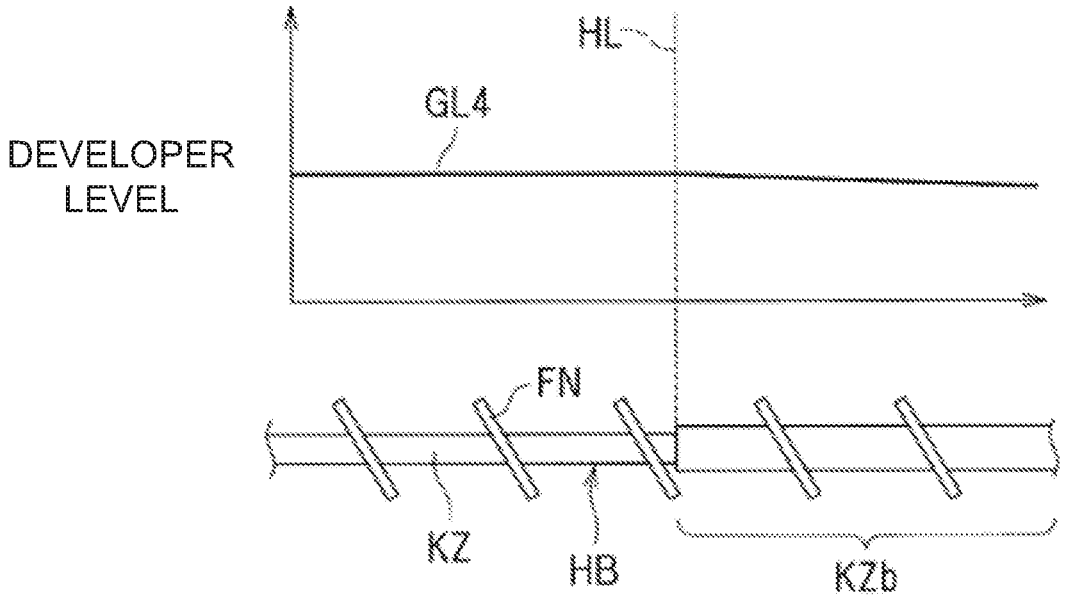
FIG. 8B illustrates an example of the distribution of the developer level when the diameter of the rotating shaft is larger than that in the second explanation example.

FIG. 8A illustrates a second explanatory example of the distribution of the developer level when each rotary shaft has a uniform diameter. FIG. 8B illustrates an example of the distribution of the developer level when the diameter of a rotary shaft is larger than that in the second explanatory example.

In addition to the stagnation of the developer, an unstable flow or circulation of the developer may cause a decrease in the level of the developer. FIG. 8A illustrates the developer level indicated by the third level line GL3 including an area having a low developer level. The third level line GL3 is constant until it reaches a predetermined position, but gradually decreases from the auxiliary line HL (to the right of the auxiliary line HL in FIG. 8A).

FIG. 8B illustrates the developer level indicated by the fourth level line GL4 corresponding to the same area as that illustrated in FIG. 8A. The rotary shaft KZ illustrated in FIG. 8B has a thick shaft portion KZb (varied-diameter section), unlike that illustrated in FIG. 8A. The thick shaft portion KZb has a diameter larger than that of the other sections of the rotary shaft KZ. Note that, the outer diameter of the spiral blade FN is uniform, and the outer diameter of the transport member HB is unchanged, like the thin shaft section KZa. The large diameter of the thick shaft section KZb of the rotary shaft KZ impairs the transportability of the developer, and thereby increases the volume of stagnated developer. As a result, the developer level, which is indicated by the fourth level line GL4, decreases in the area corresponding to the thick shaft section KZb. Thus, the developer level in the area corresponding to the thick shaft section KZb becomes substantially the same as that in other areas.

As described above, the varied-diameter section is provided to change the transportability of the developer, and thereby alleviating the unevenness in the level of the developer in the developer tank 50. The developing device 12 may include multiple varied-diameter sections. For example, the first screw 60 and the second screw 70 may each have a varied-diameter section, or each transport member HB may have multiple varied-diameter sections. For example, the first screw 60 may have a thin shaft section KZa at one end and a thick shaft section KZb on the other end.

The varied-diameter section may be provided in areas in which the developer readily stagnates, besides the turn-back zones of the developer. In other words, a varied-diameter section is disposed near an inlet port through which the developer is supplied to the developer tank 50, to alleviate stagnation of the developer.

Note that the embodiments disclosed herein are illustrative in all respects and do not serve as a basis for limited interpretation. Therefore, the technical scope of the invention should not be interpreted only by the above-described embodiments, but should be defined based on the description of the scope of claims. Meanings equivalent to the claims and all modifications within the scope are included in the technical scope of the invention.

What is claimed is:

1. A developing device comprising:

a developer tank that holds a two-component developer comprising a toner and a magnetic carrier; and a transporting member that stirs and transports the two-component developer in the developer tank, the transporting member comprising:

a first screw comprising a first rotary shaft having a first spiral blade disposed on an outer circumferential face of the first rotary shaft; and a second screw comprising a second rotary shaft having a second spiral blade disposed on an outer circumferential face of the second rotary shaft, the first screw and the second screw being disposed such that the first rotary shaft and the second rotary shaft are parallel to each other, and rotating to circulate the two-component developer in the developer tank, the developer tank comprising:

a first compartment accommodating the first screw;

a second compartment accommodating the second screw;

a partition that separates the first compartment and the second compartment; and a circulation zone disposed at an end in an axial direction along the first and second rotary shafts, the circulation zone including an opening in the partition that allows the two-component developer to flow through between the first compartment and the second compartment, the first compartment and the second compartment having bottom faces at different heights, and a protrusion being formed on a bottom face in the circulation zone, wherein the circulation zone comprises:

a first circulation zone that is disposed at one end in the axial direction and allows the two-component developer to flow from the second compartment to the first compartment; and a second circulation zone that is disposed at another end in the axial direction and allows the two-component developer to flow from the first compartment to the second compartment, and the protrusion is provided in the first circulation zone and the second circulation zone.

2. The developing device according to claim 1, wherein the protrusion comprises a slope that varies a height of the protrusion along a direction in which the two-component developer flows.

3. The developing device according to claim 1, wherein one of the first screw and the second screw is disposed upstream in a flow direction and rotates to move the two-component developer from above downward on a side facing the partition, and another one of the first screw and the second screw is disposed downstream in the flow direction and rotates to move the two-component developer from above downward on a side facing the partition, the flow direction being a direction in which the two-component developer flows in the circulation zone.

4. The developing device according to claim 1, wherein at least one of the first screw and the second screw has a rib in an area facing the circulation zone, the rib extending in the axial direction and being erected on the outer circumferential face of the first or second rotary shaft.

5. The developing device according to claim 1, wherein a bottom face of the developer tank is so tilted as to vary in height between the first compartment and the second compartment.

6. The developing device according to claim 1, wherein a bottom face of the developer tank has a step defined by the first compartment and the second compartment.

7. The developing device according to claim 1, wherein at least one of the first screw and the second screw has a varied-diameter section in an area facing the circulation zone, the varied-diameter section being different from other sections in diameter of the first or second rotary shaft.

8. An image forming apparatus comprising:

the developing device according to claim 1.

9. A developing device comprising:

a developer tank that holds a two-component developer comprising a toner and a magnetic carrier; and a transporting member that stirs and transports the two-component developer in the developer tank, the transporting member comprising:

a first screw comprising a first rotary shaft having a first spiral blade disposed on an outer circumferential face of the first rotary shaft; and a second screw comprising a second rotary shaft having a second spiral blade disposed on an outer circumferential face of the second rotary shaft, the first screw and the second screw being disposed such that the first rotary shaft and the second rotary shaft are parallel to each other, and rotating to circulate the two-component developer in the developer tank, the developer tank comprising:

a first compartment accommodating the first screw;

a second compartment accommodating the second screw;

a partition that separates the first compartment and the second compartment; and a circulation zone disposed at an end in an axial direction along the first and second rotary shafts, the circulation zone including an opening in the partition that allows the two-component developer to flow through between the first compartment and the second compartment, the first compartment and the second compartment having bottom faces at different heights, and a protrusion being formed on a bottom face in the circulation zone, wherein a bottom face of the developer tank has a step defined by the first compartment and the second compartment.

10. The developing device according to claim 9, wherein the protrusion comprises a slope that varies a height of the protrusion along a direction in which the two-component developer flows.

11. The developing device according to claim 9, wherein one of the first screw and the second screw is disposed upstream in a flow direction and rotates to move the two-component developer from above downward on a side facing the partition, and another one of the first screw and the second screw is disposed downstream in the flow direction and rotates to move the two-component developer from above downward on a side facing the partition, the flow direction being a direction in which the two-component developer flows in the circulation zone.

12. The developing device according to claim 9, wherein at least one of the first screw and the second screw has a rib in an area facing the circulation zone, the rib extending in the axial direction and being erected on the outer circumferential face of the first or second rotary shaft.

13. The developing device according to claim 9, wherein at least one of the first screw and the second screw has a varied-diameter section in an area facing the circulation zone, the varied-diameter section being different from other sections in diameter of the first or second rotary shaft.

* * * * *